US009418798B2

(12) United States Patent
Nakatani et al.

(10) Patent No.: US 9,418,798 B2
(45) Date of Patent: Aug. 16, 2016

(54) KEYBOARD

(71) Applicant: Panasonic Intellectual Property Management Co., Ltd., Osaka (JP)

(72) Inventors: Hitoshi Nakatani, Osaka (JP); Atushi Sakata, Osaka (JP); Takahiro Tabata, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/580,933

(22) Filed: Dec. 23, 2014

(65) Prior Publication Data

US 2015/0179358 A1 Jun. 25, 2015

(30) Foreign Application Priority Data

Dec. 25, 2013 (JP) ..... 2013-267796
Dec. 18, 2014 (JP) ..... 2014-256383

(51) Int. Cl.
*H01H 3/12* (2006.01)
*H01H 13/86* (2006.01)

(52) U.S. Cl.
CPC ..... *H01H 3/12* (2013.01); *H01H 13/86* (2013.01); *H01H 2221/06* (2013.01); *H01H 2223/034* (2013.01)

(58) Field of Classification Search
CPC ..... H01H 2221/06; H01H 13/86; H01H 3/12; H01H 2223/034
USPC ..... 200/5 A, 512–517, 553, 557, 315, 316, 200/339, 341–345
See application file for complete search history.

(56) References Cited

U.S. PATENT DOCUMENTS 3,917,917 A * 11/1975 Murata ..... H01H 13/702 200/292
4,467,150 A * 8/1984 Leitermann ..... H01H 13/70 200/292
5,335,137 A * 8/1994 English ..... H05F 3/02 174/5 SG
5,399,824 A * 3/1995 Chen ..... H01H 13/705 200/345
2010/0232861 A1 9/2010 Shibata et al.

FOREIGN PATENT DOCUMENTS

JP 5-19924 1/1993
JP 7-16338 3/1995
JP 2011-187298 9/2011

* cited by examiner

*Primary Examiner* — Edwin A. Leon
(74) *Attorney, Agent, or Firm* — Wenderoth, Lind & Ponack, L.L.P.

(57) ABSTRACT

A keyboard including a plurality of keys, a baseplate which supports each of the keys, and a frame which is arranged to stand substantially perpendicularly to the baseplate and to surround the each of the keys, in which the each of the keys includes an keycap configured to be depressed, the keycap including a keycap top end which constitutes a top end of the keycap and a keycap sidewall which hangs down from an edge of the keycap top end to the baseplate, and in which the baseplate has a hole arranged at a site that corresponds to a bottom end of the keycap sidewall, the hole configured to insert the bottom end of the keycap sidewall therein from above, and in which, when the keycap is in a depressed state, the bottom end of the keycap sidewall is inserted into the hole.

4 Claims, 3 Drawing Sheets

KEYBOARD

BACKGROUND

1. Technical Field

The present disclosure relates to a keyboard used for manipulating an electronic device.

2. Related Art

As is well known, keyboards, which have a number of keys arrayed on a baseplate, are commonly used as operational means for operating electronic devices such as so-called personal computers (properly abbreviated as "PC", hereinafter) and information terminal devices, for example. In the conventional keyboards, adjacent keys are generally arrayed such that bottom ends of the sidewalls of the keys, which slant outward-downward from edges of top ends of keycaps, are lined with a predetermined clearance therebetween. In these cases, keyboards in which protecting sheets are deployed are known. This aims to prevent fluid or dust from breaking in through the clearances between keycaps of neighboring keys and the like (see JP 2011-187298 A, for example).

Further, so-called isolation keyboards (or called as island-type keyboards), in which adjacent keys are separated with frames such that the frames surrounds respective keys, have been adopted in some cases to achieve compactification and secure keystrokes as well as to enhance the sophistication in design, for example.

SUMMARY

In the above mentioned isolation keyboards, frames surrounding respective keys are normally arranged such that they stand approximately-perpendicularly to baseplates which support the keys. Clearances are arranged between the inner side faces of the frames and keycap sidewalls hanging down from the edges of the top ends of the keycaps. In such cases, the keycap sidewalls are normally formed such that they hang down from the edges of the top ends of the keycaps to the baseplate with an aim of compactification of the respective keys and securing excellence in keying operation.

In keyboards which are compactly manufactured to have slimline profile of the entire bodies, if the sidewalls of the keycaps are formed such that they hang down from the edge of the top ends of the keycaps to the baseplate as mentioned above, there may be cases where a tip of a finger of an operator (a user) who strokes a key get into the clearance between the keycap sidewalls and the inner side face of the frame. In these cases, if the tip hooks a bottom end face of the keycap sidewall, a force having a direction to exfoliate the keycap from the baseplate acts on the keycap. In this context, it may be thought that this issue can be avoided by designing the keycaps such that the bottom end faces of the keycap sidewalls take positions below the top end face of the frame in the situation where the keys are not depressed.

In the case where the keycap sidewalls are formed such that they hang down from the edges of the top ends of the keycaps to the baseplate, it is sometimes disadvantageous in securing an adequate depression-stroke (a keystroke) for depressing the keycap, that is, an interval which the keycap sidewall travels to touch the top face of the baseplate in the limited space within the key due to the compactification. This is more apparent in the case where the keycaps are designed such that the bottom end faces of the keycap sidewalls may take positions below the top end faces of the frames even when the keys are not depressed as mentioned above.

Accordingly, one non-limiting and exemplary embodiment provides a so-called isolation keyboard in which an adequate keystroke is secured even if the keycaps sidewalls are configured such that they hang down from the edges of the top ends of the keycaps to the baseplate.

For this, the present disclosure provides a keyboard: a) which includes a plurality of keys, a baseplate which supports each of the keys, and a frame which is arranged to stand substantially perpendicularly with respect to the baseplate and to surround the each of the keys; and b) in which the each of the keys includes an keycap configured to be depressed, the keycap including a keycap top end which constitutes a top end of the keycap and a keycap sidewall which hangs down from an edge of the keycap top end to the baseplate; and c) in which the baseplate has a hole arranged at a site that corresponds to a bottom end of the keycap sidewall, the hole configured to insert the bottom end of the keycap sidewall therein from above; and d) in which, when the keycap is in a depressed state at which the key is depressed, the bottom end of the keycap sidewall is inserted into the hole.

According to the keyboard of the present disclosure, the bottom end of the keycap sidewall is inserted into the hole of the baseplate in the depressed state of the keycap. Hence, the keystroke can be secured largely in accordance with an amount of the insertion. Accordingly, in the so-called isolation keyboard, an adequate keystroke can be secured even when the keycap sidewall is formed such that it hangs down from the edge of the keycap to the baseplate.

DETAILED DESCRIPTION

Figure 1:
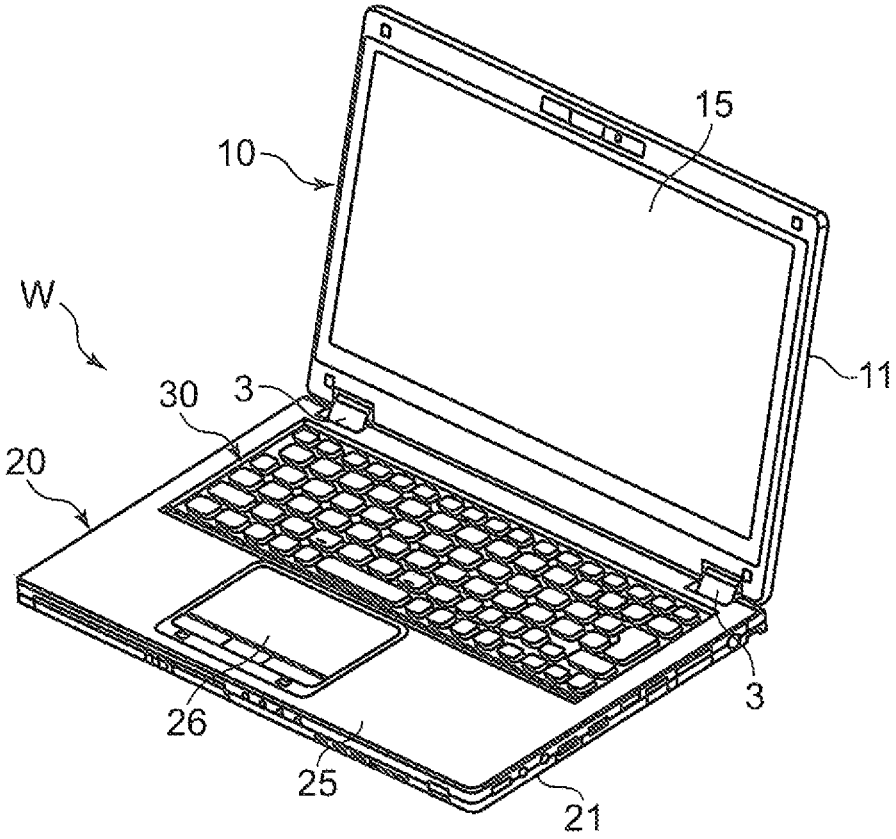
FIG. 1 is a full-perspective view illustrating a notebook-sized personal computer according to an exemplary embodiment of the present disclosure in an operational state.

The configuration mentioned above is a basic configuration of an electronic device of the present disclosure. However, the electronic device may have several modes as illustrated below. This means that the keycap sidewall may be formed such that the bottom end face thereof takes a position below a top end face of the frame in a non-depressed state at which the keycap is not depressed.

By this configuration, the bottom end face of the keycap sidewall is positioned below the top end face of the frame even in a non-depressed state of the keycap. Hence, even when a tip of a finger of a user get into a clearance between the keycap sidewall and an inner side face of the frame while he/she typing the key, the tip is prevented from being hooked into the bottom end of the keycap sidewall. Therefore, occurrence of such the situation can be prevented.

In addition, as for a portion of the edge of the keycap top end, it may be configured as that the hang down length of the keycap sidewall hanging down from the portion is longer than a keycap sidewall hanging down from the other portion of the edge. The bottom end face of the keycap sidewall of which hang down length is configured to be longer may be positioned below the top end face of the frame in the non-depressed state at which the keycap is not depressed. The hole which corresponds to the down below of the keycap sidewall of which hang down length is configured to be longer may be arranged by penetrating the baseplate.

By this configuration, it never results in bad effect on securing the keystrokes since the portion of the keycap sidewall of which hang down length is configured to be longer is inserted into the hole which penetrates through the baseplate in the depressed state. Accordingly, it makes possible to configure the keycap sidewall such that the bottom end face of the keycap sidewall of which hang down length is configured to be longer can be positioned sufficiently below the top end face of the frame even in the non-depressed state without resulting in bad effect on the securing of the keystroke. Even if a tip of a finger of a user get into clearance between the keycap sidewall and an inner side face of the frame while typing, it effectively prevents the tips from being hooked into the bottom end face of the keycap sidewall. Therefore occurrence of such the situation can surely be prevented.

In this case, a detecting device which detects a depression of a keycap may be arranged under the keycap. A signal line which outputs an output signal from the detecting device may be wired such that it goes through a region which corresponds to the down below of the above mentioned other portion of the keycap sidewall of which hang down length is relatively short.

In this configuration, the signal line can be wired efficiently using the region under the portion of keycap sidewall of which hang down length is relatively short.

In the cases above mentioned, the keycap top end may be formed such that it can be seen as a tetragon from above. In the edges of the corner portions of the tetragon, the keycap sidewalls hanging down therefrom may be configured such that their hang down length be longer than the keycap sidewalls hanging down from the other edges.

By this configuration, as for the keycap of which keycap top end is configured as it can be seen as a tetragon from above, even in the case where a tip of a finger of a user get into the clearance between the keycap sidewall and the inner side face of the frame while typing, it can surely prevent the tip of the finger of the user from being hooked in the bottom end face of the keycap sidewall without resulting in bad effect on the ensuring of the keystrokes. In addition, signal lines can be wired by efficiently utilizing the downward regions under the side portions of the tetragon where the hang down lengths of the keycap sidewalls are relatively short.

(Embodiment)

Below, an exemplary embodiment is described in detail by appropriately making reference to drawings. However, unnecessarily detailed description will be omitted in some cases. For example, detailed description of already well-known matters and repetition of descriptions of substantially the same configuration may be omitted. All of such omissions are intended to facilitate the understanding by those skilled in the art by avoiding unnecessarily redundancy in the following description.

The inventor(s) provides the attached drawings and the following description for those skilled in the art to fully understand the present disclosure and does not intend to limit the subject matter stated in the claims by means of the attached drawings and the following description.

In the description below, terms which mean specific directions ("up", "down", "left", and "right", and other terms including such words, and "clockwise direction" and "counterclockwise direction", for example) are used in some cases. However, they are used to facilitate the understanding of the disclosure which refers to the drawings. The present disclosure should not be understood in a limited fashion based on the meaning of those terms.

The embodiment of the present disclosure described below is an example, in which it is applied to a so-called notebook-sized personal computer.

Figure 2:
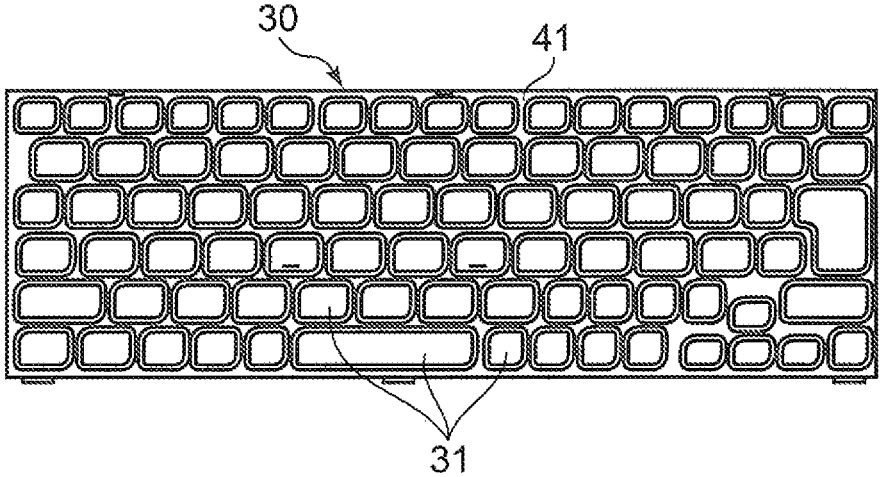
FIG. 2 is a plan view of a keyboard of the notebook-sized personal computer.

FIG. 1 is a full-perspective view illustrating the notebook-sized personal computer in an operational state which serves as an electronic device according to the exemplary embodiment. FIG. 2 is a plan view of the keyboard of the notebook-sized personal computer.

As shown in FIG. 1, the notebook-sized personal computer W according to the present embodiment includes a display unit 11 having a display screen 15 of a liquid crystal type and an operational control unit 20 which is capable of generating a display signal to be inputted to the display unit 10, for example. The operational control unit 20 includes a keyboard 30 serving as an input device, a signal processing circuit or a central processing unit (a so-called CPU), which generates a display signal to be outputted to the display unit 10 based on input operations by means of the keyboard 30 or the like, and another peripheral components thereof. (They all are not shown). Furthermore, a palm rest 25 on which a user may put his/her palms of the hands is arranged in the near side of the keyboard 30 from the user who operates the notebook-sized personal computer W. In the central region of the palm rest 25, a touch-pad 26 is disposed.

The display unit 10 is built into a casing 11 of a display unit side (a first casing), which covers the rear side and the edges of the display unit 10. As for the operational control unit 20, it is built into another casing 21 of an operational control unit side (a second casing). The casings 11, 21 are openably and closably conjoined with hinge mechanisms 3. Total basic forms of both of the first casing 11 and the second casing 21 are formed in approximate rectangular shapes. It is to be noted that, in the present description, the "rectangle" includes a "regular square" as one form thereof.

As also shown in FIG. 2, the keyboard 30 includes a number of keys 31. In the present embodiment, the keyboard 30 is configured as a so-called isolation keyboard (or called as an island-type keyboard), in which adjacent keys 31 are separated by a frame 41 so that the frame surrounds respective keys 31.

Figure 5:
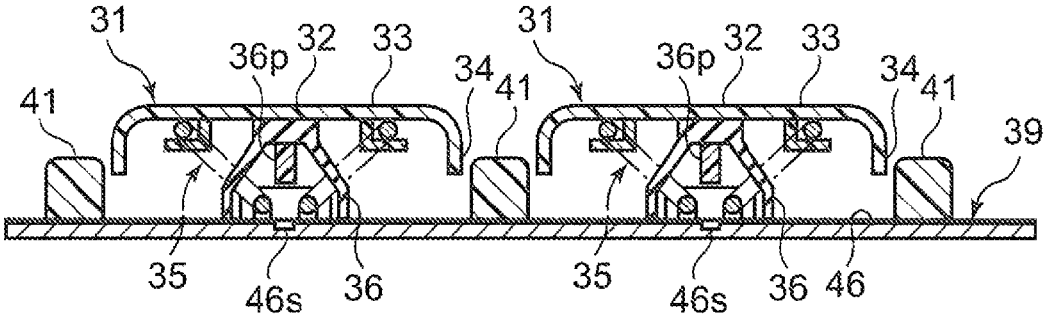
FIG. 5 is a vertical sectional view showing a cross sectional structure of the keyboard including the keycap and the frame.
Figure 6:
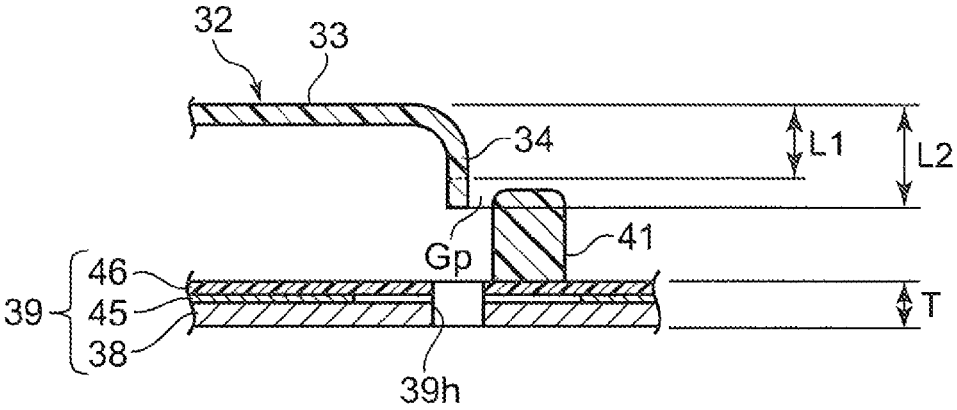
FIG. 6 is an enlarged vertical sectional view showing a keycap sidewall and the frame in a situation where the keycap is not manipulated.
Figure 7:
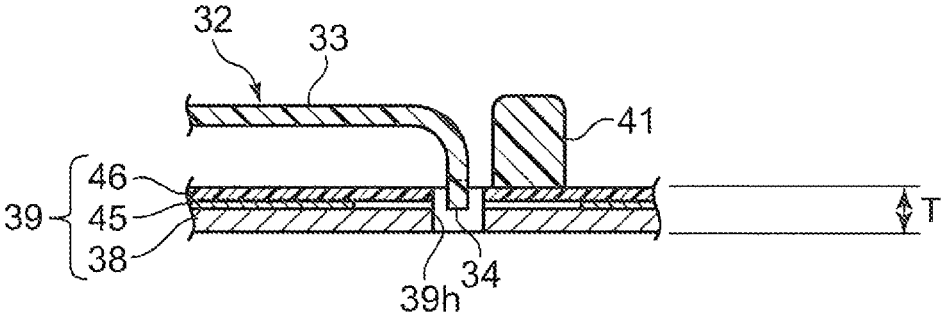
FIG. 7 is an enlarged vertical sectional view showing the keycap sidewall and the frame in a situation where the keycap is depressed.

As illustrated in FIG. 5, respective keys 31 are supported on a thin-plate base member 38 made of a metallic thin plate, for example. In detail further, as depicted in FIG. 6 and FIG. 7, a so-called flexible printed circuit board 45 (FPC board), which of itself has a high flexibility, and a membrane sheet 46 are arranged on the thin-plate base member 38 in this order, for example. To be exact, respective keys 31 are supported on the thin-plate base member 38 via the FPC board 45 and the membrane sheet 46.

Although not shown in the figures specifically, it is to be noted that a number of integrally-formed projections are provided on the bottom face of the membrane sheet 46, and a number of holes are correspondingly provided on the thin-plate base member 38. The numerous projections are fitted and fixed in the numerous holes of the thin-plate base member 38 with the FPC board sandwiched between the membrane sheet 46 and the thin-plate base member 38, and, thereby, the membrane sheet 46, the FPC board 45, and the thin-plate base member 38 are integrated with each other.

In the present embodiment, the thing which is formed by integrating the thin-plate base member 38, the FPC board 45 and the membrane sheet 46 integrally arranged on the thin-plate base member 38 is referred to as a baseplate 39. Accordingly, respective keys 31 are supported on the baseplate 39, and the frame 41 is arranged so as to stand approximately perpendicularly to the baseplate 39 and surround the respective keys 31. In the present embodiment, the thickness T of the baseplate 39 is 0.5 mm, for example. It is to be noted that, in FIG. 5, the thin-plate base member 38, the FPC board 45, and the membrane sheet 46 are not separately depicted to prevent the depiction from being excessively minute and complicated.

In addition, each of the keys 31 has a keycap 32 which can be depressed by a user. The keycap 32 includes a keycap top end 33 which constitutes a top end of the keycap 32 and a keycap sidewall 34 which hangs down from an edge of the keycap top end 33 substantially perpendicularly to the baseplate 39 as shown in detail in FIG. 3 and FIG. 4.

The keycaps 32 of respective keys 31 are elevatably supported on the baseplate 39 via pantograph mechanisms 35 and rubber springs 36. A projected portion 36*p* projecting downwardly is integrally formed at the center of the rubber spring 36. The projected portion 36*p* faces a membrane switch 46*s* arranged on the membrane sheet in a non-operation state where the keycap 32 is not depressed.

When the keycap 32 is depressed by a user while he/she typing the keys, the pantograph mechanism 35 and the rubber spring 36 performs a downward contraction operation. Accordingly, the projected portion 36*p* of the rubber spring 36 pushes the membrane switch 46*s*. Although not shown in the figure specifically, the membrane switch 46*s* has a contact portion and the contact portion includes a movable contact and a fixed contact. The movable contact makes contact with the fixed contact and they are electrically closed when the movable contact is pushed by the projected portion 36*p* of the rubber spring 36. The membrane switch 46*s* detects the depression of the keycap 32 by the electrical closure. A detection signal is outputted through a signal line wired on the flexible printed circuit board (FPC board) 45. Necessitated operation in the personal computer W is performed in accordance with the output signal.

When the depression of the keycap 32 by the user is released, the contact portion of the membrane switch 46*s* is opened and the pantograph mechanism 35 expands upward due to the elastic reaction force of the rubber spring 36.

Thereby, the keycap 32 returns to its initial position (non-operation position). It is to be noted that the elevation mechanism for the keycap 32 including the pantograph mechanism 35, the rubber spring 36, and the membrane sheet 46 is similar to those that have already known to the public. For example, the elevation mechanism disclosed in JP 2011-187298 A may be used.

In the present embodiment, as shown in FIG. 6 and FIG. 7, a hole 39*h* into which the bottom end of the keycap sidewall 34 can be inserted from above is arranged at a site of the baseplate 39 that corresponds to the bottom end of the keycap sidewall 34. When the key is in a depressed state at which the keycap 32 is depressed, the bottom end of the keycap sidewall 34 is inserted into the hole 39*h* of the baseplate 39.

As described, the bottom end of the keycap sidewall 34 is inserted into the hole 39*h* of the baseplate 39 at the depressed state of the keycap 32. Hence, the keystroke thereof can be largely secured in accordance with an amount of the insertion. Accordingly, in the so-called isolation keyboard, an adequate keystroke can be secured even when the keycap sidewall 34 is formed such that it hangs down from the edge of the keycap 32 to the baseplate 39.

Furthermore, in the case mentioned above, as shown in FIG. 6, the keycap sidewall 34 is formed such that the bottom end face thereof takes a position below the top end face of the frame 41 in a non-depressed state at which the keycap 32 is not depressed. In this case, the bottom end face of the keycap sidewall 34 is positioned below the top end face of the frame 41 even in the non-depressed state of the keycap 32. Even if a tip of a finger of a user get into clearance between the keycap sidewall 34 and an inner side face of the frame 41 while he/she typing the key, it prevents the tip from being hooked into the bottom end of the keycap sidewall 34. Therefore, occurrence of such the situation can be prevented.

Figure 3:
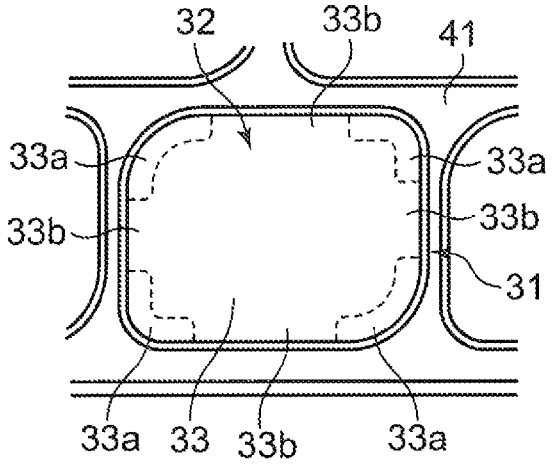
FIG. 3 is an enlarged plan view illustrating a keycap and a frame of the keyboard.
Figure 4:
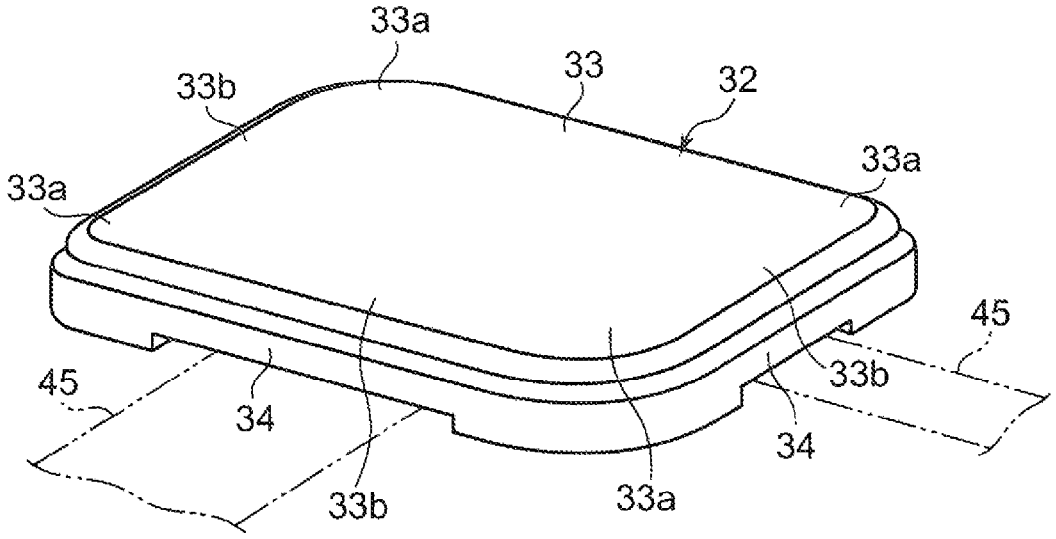
FIG. 4 is an enlarged perspective view illustrating the keycap.

In detail, in the present embodiment, the keycap top end 33 is formed such that it can be seen as a tetragon from above (see FIG. 3 and FIG. 4). In the edges of the corner portions 33*a* of the tetragon, the keycap sidewall 34 hanging down therefrom may be configured such that their hang down length L2 be longer than the hang down length L1 of the keycap sidewall 34 which hang down from the other edges 33*b* (that is, side portions of the tetragon). In the present embodiment, the hang down length L2 which is the length of the keycap sidewall 34 hanging down from the edges of the corner portions 33*a* of the tetragon is 1.4 mm, for example, and the hang down length L1 which is the length of the keycap sidewall 34 hanging down from the side portions 33*b* of the tetragon is 1.0 mm, for example.

In short, as for the portion 33*a* of the edge of the keycap top end 33, it is configured as that the hang down length L2 of the keycap sidewall 34 hanging down from the portion 33*a* is longer than the hang down length L1 of the keycap sidewall 34 hanging down from the other portion 33*b* of the edge. As shown in FIG. 6, the bottom end face of the keycap sidewall 34 of which hang down length is configured to be longer (L2) is positioned below the top end face of the frame 41 by E mm (approximately 0.5 mm in the present embodiment) in the non-depressed state at which the keycap is not depressed. The hole 39*h* of the baseplate 39, which corresponds to the down below of the keycap sidewall 34 of which hang down length is configured to be longer, is arranged by penetrating the baseplate.

By this configuration, it never results in bad effect on securing the keystrokes since the portion of the keycap sidewall 34 of which hang down length is configured to be longer is inserted into the hole 39*h* which penetrates through the baseplate 39 in the depressed state. In other words, it makes possible to configure the keycap sidewall such that the bottom end face of the keycap sidewall 34 of which hang down length is configured to be longer (L2) can be positioned sufficiently below the top end face of the frame 41 even in the non-depressed state without resulting in bad effect on securing the keystroke. Even if the tip of the finger of the user get into clearance Gp between the keycap sidewall 34 and an inner side face of the frame 41 while typing, it effectively prevents the tip from being hooked into the bottom end face of the keycap sidewall 34.

Therefore occurrence of such the situation can surely be prevented.

In the present embodiment, the pantograph mechanism 35, the rubber spring 36 with the projected portion 36*p*, the membrane sheet 46, and the membrane switch 46*s* are disposed underneath the keycap 32 as the detecting device which detects the depression of the keycap 32. The FPC board 45 on which the signal line which outputs an output signal from the detecting device is wired is disposed extending through the region which corresponds to the down below of the keycap sidewall 34 of which hang down length (L1) of the keycap sidewall 34 hanging down from the edge of the keycap top end 33 is configured to be shorter as compared to the hang down length (L2) of the keycap sidewall 34 hanging down from the edge of the corner portion 33*a* of the tetragon (that is, the region beneath the side portion 33*b* of the tetragon) (see FIG. 4).

Accordingly, especially as for the keycap 32 of which keycap top end 33 is configured as it can be seen as a tetragon from above, even in the case where the tip of the finger of the user get into the clearance between the keycap sidewall 34 and the inner side face of the frame 41 while typing, it can surely prevent the tip of the finger of the user from being hooked in the bottom end face of the keycap sidewall 34 without resulting in bad effect on the ensuring of the keystrokes. In addition, signal lines can be wired efficiently utilizing the downward regions underneath the side portions 33*b* of the tetragon where the hang down lengths (L1) of the keycap sidewalls 34 are relatively short.

As described, the embodiment is explained as an example of the art of the present disclosure. For that purpose, the accompanying drawings and detailed description are provided. Therefore, the feature constituents described in the detailed description and the accompanying drawings may contain not only essential feature constituents for solving the problem but non-essential feature constituents for illustrating the art. Accordingly, it should not be instantly understood that such the non-essential constituents are essential simply because those non-essential constituents are shown or described in the accompanying drawings and the detailed description.

The embodiment above is illustrated using an example where it is applied to a so-called notebook-sized personal computer. The keyboard of the present disclosure should not be limited in such the case. It can be effectively applied to a keyboard used for various types of electronic devices.

Also, since the above described embodiment is provided for exemplifying the art of the present disclosure, the embodiment may be subjected to various kinds of modification, substitution, addition, omission, or the like without departing from the scope of the claims and their equivalents.

The present disclosure is effectively applicable to a keyboard used for manipulating an electronic device such as a notebook-sized personal computer and an information terminal device.

What is claimed is:

1. A keyboard comprising a plurality of keys, a baseplate which supports each of the keys, and a frame which is arranged to stand substantially perpendicularly with respect to the baseplate and to surround the each of the keys, wherein the each of the keys includes a keycap configured to be depressed, the keycap including a keycap top end which constitutes a top end of the keycap and a keycap sidewall which hangs down from an edge of the keycap top end to the baseplate, wherein the baseplate has a hole arranged at a site that corresponds to a bottom end of the keycap sidewall, the hole configured to insert the bottom end of the keycap sidewall therein from above, wherein, when the keycap is in a depressed state at which the key is depressed, the bottom end of the keycap sidewall is inserted into the hole, wherein, as for a portion of the edge of the keycap top end, a hang down length of the keycap sidewall hanging down from the portion is longer than a keycap sidewall hanging down from the other portion of the edge, wherein a bottom end face of the keycap sidewall of which hang down length is configured to be longer is positioned below a top end face of the frame in the non-depressed state at which the keycap is not depressed, and wherein the hole which corresponds to down below of the keycap sidewall of which hang down length is configured to be longer is arranged by penetrating the baseplate.

2. The keyboard according to claim 1, wherein a detecting device which detects depression of the keycap is arranged under the keycap, wherein a signal line which outputs an output signal from the detecting device is wired as that the signal line goes through a region which corresponds to the down below of the other portion of the keycap sidewall of which hang down length is relatively short.

3. The keyboard according to claim 1, wherein the keycap is configured to be seen as a tetragon from above, wherein, as for an edge of a corner portion of the tetragon, the keycap sidewall hanging down therefrom is configured as that its hang down length is longer than the keycap sidewall hanging down from the other edges.

4. The keyboard according to claim 2, wherein the keycap is configured to be seen as a tetragon from above, wherein, as for an edge of a corner portion of the tetragon, the keycap sidewall hanging down therefrom is configured as that its hang down length is longer than the keycap sidewall hanging down from the other edges.

* * * * *